US011293176B2

(12) United States Patent
Sawada et al.

(10) Patent No.: US 11,293,176 B2
(45) Date of Patent: Apr. 5, 2022

(54) SOUNDPROOFING CONTROL SYSTEM, SOUNDPROOFING CONTROL DEVICE, SOUNDPROOFING CONTROL METHOD, AND PROGRAM

(71) Applicant: MITSUBISHI HEAVY INDUSTRIES COMPRESSOR CORPORATION, Tokyo (JP)

(72) Inventors: Yuichiro Sawada, Tokyo (JP); Yuzo Tsurusaki, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 802 days.

(21) Appl. No.: 16/182,739

(22) Filed: Nov. 7, 2018

(65) Prior Publication Data

US 2019/0136517 A1 May 9, 2019

(30) Foreign Application Priority Data

Nov. 9, 2017 (JP) ..... JP2017-216289

(51) Int. Cl.
*E04B 1/99* (2006.01)
*G10K 11/162* (2006.01)
(Continued)

(52) U.S. Cl.
CPC ..... *E04B 1/99* (2013.01); *F01D 25/24* (2013.01); *G10K 11/162* (2013.01); *G10K 11/172* (2013.01)

(58) Field of Classification Search
CPC .... G10K 11/162; G10K 11/172; F01D 25/24; F01D 25/26; E04B 1/8218; E04B 1/99; E04B 1/994
(Continued)

(56) References Cited

U.S. PATENT DOCUMENTS 5,130,948 A 7/1992 Laukien et al.
5,515,444 A * 5/1996 Burdisso ..... G10K 11/1785 381/71.5
(Continued)

FOREIGN PATENT DOCUMENTS

CN 104131626 A 11/2014
DE 102015103936 A1 9/2016
(Continued)

OTHER PUBLICATIONS

Notice of Reasons for Refusal issued in corresponding Japanese Patent Application No. 2017-216289, dated Jun. 1, 2021 (8 pages).

*Primary Examiner* — Jeremy A Luks
(74) *Attorney, Agent, or Firm* — Osha Bergman Watanabe & Burton LLP

(57) ABSTRACT

To improve soundproofing performance of a soundproofing wall constituted by wall members overlapping with a hollow portion therebetween.

A resonance state of an outer wall member of a soundproofing wall which includes an inner wall member on the side of a sound generation source, an outer wall member outwards from the inner wall member with respect to a position of the generation source, and a hollow portion which is provided between the inner wall member and the outer wall member is detected. A pressure of the hollow portion is adjusted so that the resonance state is a minimum based on adjustment of the pressure of the hollow portion.

8 Claims, 8 Drawing Sheets

(51) Int. Cl.
*F01D 25/24* (2006.01)
*G10K 11/172* (2006.01)

(58) Field of Classification Search
USPC ..... 181/198, 200
See application file for complete search history.

(56) References Cited

U.S. PATENT DOCUMENTS

| | | | | |
|---|---|---|---|---|
| 9,163,837 | B2 * | 10/2015 | Sutcu | F23R 3/46 |
| 9,366,025 | B2 * | 6/2016 | Ho | E01F 8/0011 |
| 9,534,387 | B2 * | 1/2017 | Anguelov | E04C 3/29 |
| 2006/0090959 | A1 * | 5/2006 | Ramenzoni | B06B 1/045 181/292 |
| 2012/0273295 | A1 * | 11/2012 | Kolaini | G10K 11/165 181/198 |
| 2016/0061075 | A1 | 3/2016 | Kimura et al. | |

FOREIGN PATENT DOCUMENTS

| | | | |
|---|---|---|---|
| JP | H03-035204 | U | 4/1991 |
| JP | H03-505129 | A | 11/1991 |
| JP | H04-168497 | A | 6/1992 |
| JP | H11-202874 | A | 7/1999 |
| JP | 2002-356934 | A | 12/2002 |
| JP | 2003-097292 | A | 4/2003 |
| JP | 2014-218924 | A | 11/2014 |
| JP | 2015-176017 | A | 10/2015 |

* cited by examiner

SOUNDPROOFING CONTROL SYSTEM, SOUNDPROOFING CONTROL DEVICE, SOUNDPROOFING CONTROL METHOD, AND PROGRAM

BACKGROUND OF THE INVENTION

Field of the Invention

The present invention relates to a soundproofing control system, a soundproofing control device, a soundproofing control method, and a program.

Description of Related Art

In order to block sound with a large sound volume generated by a sound generation source, the sound generation source may be covered with soundproofing walls. A technology for soundproofing with respect to sound generated by a generation source is disclosed in Patent Document 1.

PATENT DOCUMENTS

[Patent Document 1] Japanese Unexamined Patent Application, First Publication No. 2014-218924

SUMMARY OF THE INVENTION

Incidentally, regarding the above soundproofing walls, there may be a soundproofing wall in which a hollow portion is provided between two rigid wall members. For example, a pair of glass pieces in which a hollow portion is provided between the two glass pieces is also an example of a soundproofing wall. In such a soundproofing wall, an outer wall member may resonate according to the vibration of an inner wall member on the side of a sound generation source and a soundproofing effect may be lost. For example, in the above soundproofing wall, at a specific resonance frequency, a sound transmission loss may decrease, and a soundproofing effect at this frequency may be lost. When this resonance frequency and a sound frequency which is the maximum level among sound frequencies generated by a generation source match, it may not be possible to perform sufficient soundproofing for the sound frequency generated by the generation source.

Here, an object of the present invention is to provide a soundproofing control system, a soundproofing control device, a soundproofing control method, and a program which solve the above problems.

According to a first aspect of the present invention, a soundproofing control system includes a soundproofing wall which includes an inner wall member on the side of a sound generation source, an outer wall member outwards from the inner wall member with respect to a position of the generation source, and a hollow portion which is provided between the inner wall member and the outer wall member; a resonance state detecting unit configured to detect a resonance state of the outer wall member of the soundproofing wall; and a pressure adjusting unit configured to adjust a pressure of the hollow portion so that the resonance state is a minimum based on the adjustment of the pressure of the hollow portion.

In the above soundproofing control system, the soundproofing wall may cover a sound generation source which is a steam condenser for steam discharged from a turbine, and the pressure adjusting unit may adjust the pressure of the hollow portion to a pressure between atmospheric pressure and an internal pressure of the steam condenser inside the steam condenser which is lower than atmospheric pressure.

In the above soundproofing control system, the pressure adjusting unit may adjust the pressure of the hollow portion with a pressure higher than atmospheric pressure enclosed in the hollow portion to a pressure between atmospheric pressure and a pressure lower than atmospheric pressure.

According to a second aspect of the present invention, a soundproofing control device includes a resonance state detecting unit configured to detect a resonance state of an outer wall member of a soundproofing wall which includes an inner wall member on the side of a sound generation source, an outer wall member outwards from the inner wall member with respect to a position of the generation source, and a hollow portion which is provided between the inner wall member and the outer wall member; and a pressure adjusting unit configured to adjust a pressure of the hollow portion so that the resonance state is a minimum based on adjustment of the pressure of the hollow portion.

According to a third aspect of the present invention, a soundproofing control method includes covering a generation source with a soundproofing wall which includes an inner wall member on the side of a sound generation source, an outer wall member outwards from the inner wall member with respect to a position of the generation source, and a hollow portion which is provided between the inner wall member and the outer wall member; detecting a resonance state of the outer wall member of the soundproofing wall; and adjusting a pressure of the hollow portion so that the resonance state is a minimum based on adjustment of the pressure of the hollow portion.

According to a fourth aspect of the present invention, a program causes a computer included in a soundproofing control device to function as: a resonance state detecting means for detecting a resonance state of an outer wall member of a soundproofing wall which includes an inner wall member on the side of a sound generation source, an outer wall member outwards from the inner wall member with respect to a position of the generation source, and a hollow portion which is provided between the inner wall member and the outer wall member; and a pressure adjusting means for adjusting a pressure of the hollow portion so that the resonance state is a minimum based on adjustment of the pressure of the hollow portion.

According to the present invention, it is possible to improve soundproofing performance of a soundproofing wall constituted by wall members overlapping with a hollow portion therebetween by changing a frequency at which a transmission loss decreases.

DETAILED DESCRIPTION OF THE INVENTION

A soundproofing control system and a soundproofing control device according to an embodiment of the present invention will be described below with reference to the drawings.

Figure 1:
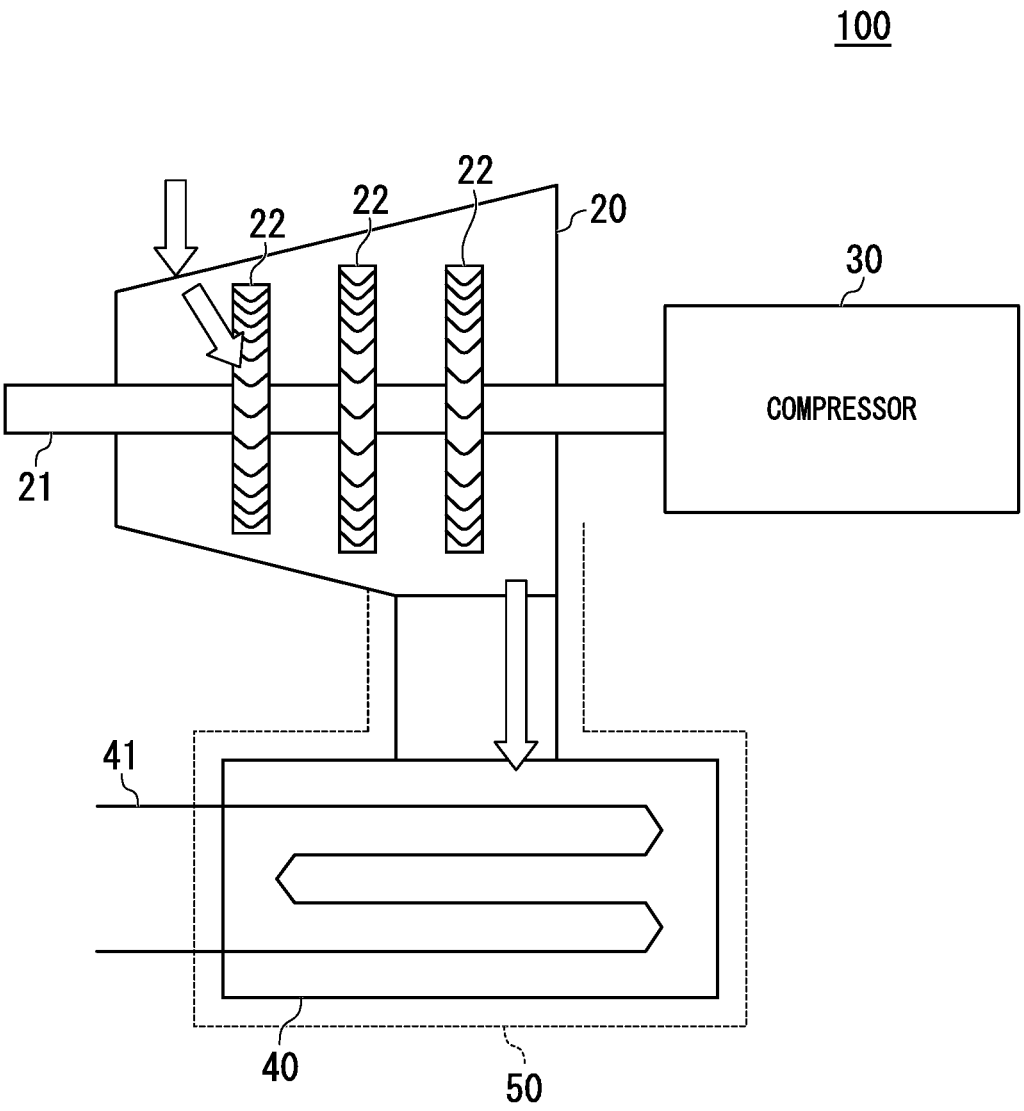
FIG. 1 is a schematic configuration diagram of a turbine system.

FIG. 1 is a schematic configuration diagram of an example of a turbine system to be soundproofed by a soundproofing control system according to the embodiment.

As shown in FIG. 1, a turbine system 100 includes a turbine 20, a compressor 30, a steam condenser 40, and a soundproofing wall 50. In the turbine 20, a turbine rotor 21 that rotates is provided, and in the turbine rotor 21, a plurality of rotor vanes 22 separated from each other in an axial direction are provided. Steam is injected into the turbine 20, and this steam strikes the rotor vane 22 and thus the rotor vane 22 rotates. According to the rotation of the rotor vane 22, the turbine rotor 21 rotates, and the compressor 30 outputs a compressed fluid based on this rotation. In the turbine system 100 in FIG. 1, a power generator may be provided in place of the compressor 30.

As a steam pressure difference between an upstream and a downstream in a flow path through which a steam of the turbine 20 flows becomes larger, a rotational power of the turbine rotor 21 becomes larger. Therefore, the steam condenser 40 is provided downstream in the flow path of the steam. A cooling water pipe 41 is provided in the steam condenser 40, and when cooling water flows through the pipe, the steam is rapidly cooled. Accordingly, a space inside the steam condenser 40 has a pressure that is substantially close to a vacuum pressure.

A large amount of sound due to vibration transmitted from the turbine 20 or the like is generated by the steam condenser 40. Therefore, the soundproofing wall 50 covering the whole is provided in the steam condenser 40.

First Embodiment

Figure 2:
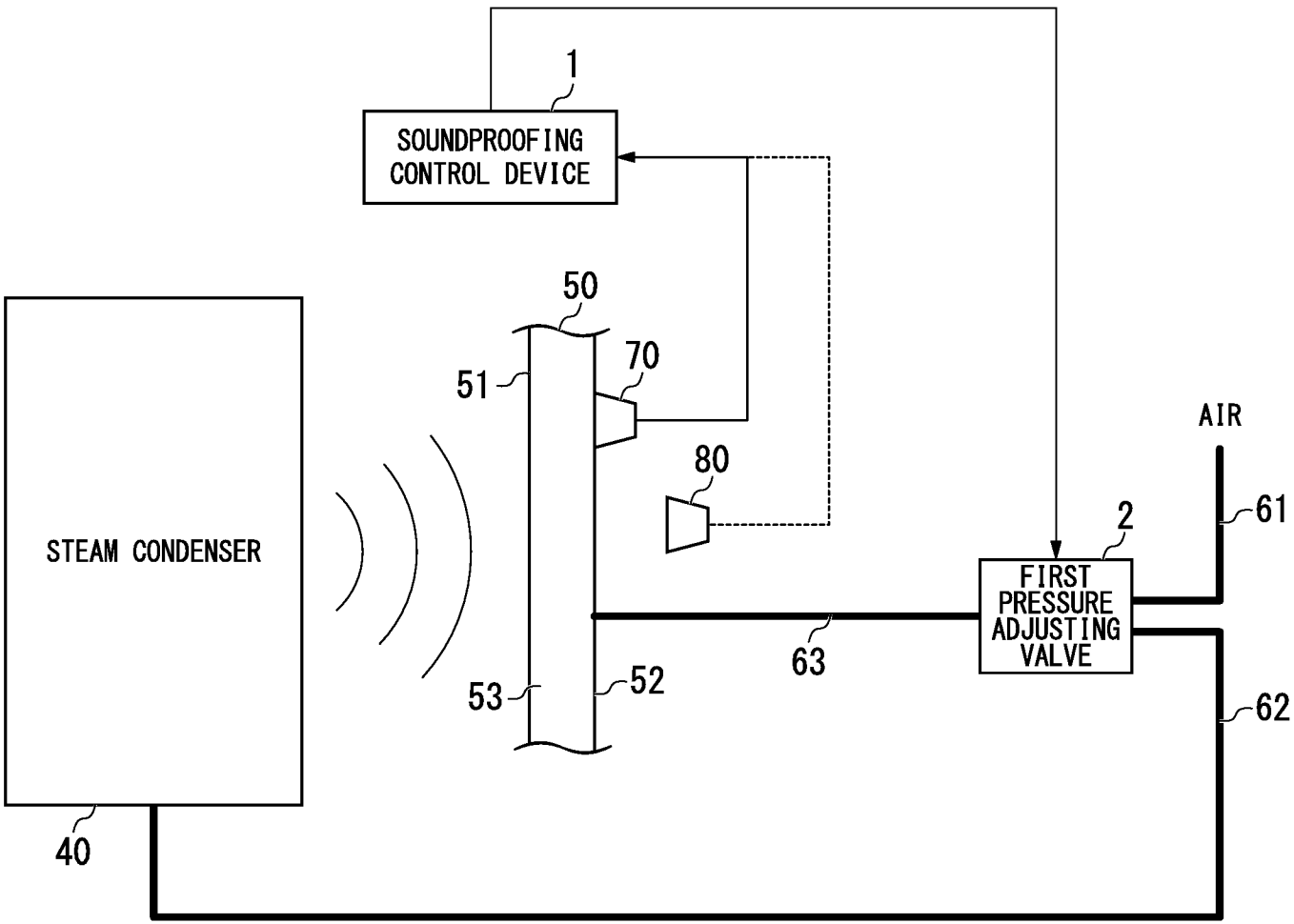
FIG. 2 is a schematic configuration diagram of a soundproofing control system.

FIG. 2 is a schematic configuration diagram of a soundproofing control system according to a first embodiment.

A shown in FIG. 2, a soundproofing control system 200 includes a soundproofing control device 1, a first pipe 61 through which air passes, a second pipe 62 that is connected to the interior of the steam condenser 40, a first pressure adjusting valve 2, a third pipe 63 through which air passes or which is connected to the steam condenser 40 according to opening and closing of the first pressure adjusting valve 2, and a vibration sensor 70 or a sound sensor 80.

The soundproofing wall 50 includes an inner wall member 51 on the side of a sound generation source such as the steam condenser 40, an outer wall member 52 outside the inner wall member 51, and a hollow portion 53 that is provided in an interval between the inner wall member 51 and the outer wall member 52. The inner wall member 51 vibrates according to sound from the steam condenser 40, and this vibration is transmitted to the outer wall member 52 via the hollow portion 53. The soundproofing control device 1 detects an amount of vibration corresponding to a vibration frequency of the outer wall member 52 using the vibration sensor 70. The soundproofing control device 1 may detect a sound volume corresponding to a sound frequency based on vibration of the outer wall member 52 using the sound sensor 80 in place of the vibration sensor 70.

The soundproofing control device 1 controls opening and closing of the first pressure adjusting valve 2 based on an amount of vibration corresponding to a vibration frequency detected by the vibration sensor 70 or a sound volume corresponding to a sound frequency detected by the sound sensor 80. When the first pressure adjusting valve 2 is opened or closed, the atmosphere or the interior of the steam condenser 40 is connected to the interior of the hollow portion 53 of the soundproofing wall 50. Therefore, the pressure of the atmosphere of the hollow portion 53 is able to be controlled such that it reaches a pressure value between the value of atmospheric pressure and a pressure value inside the steam condenser 40.

Figure 3:
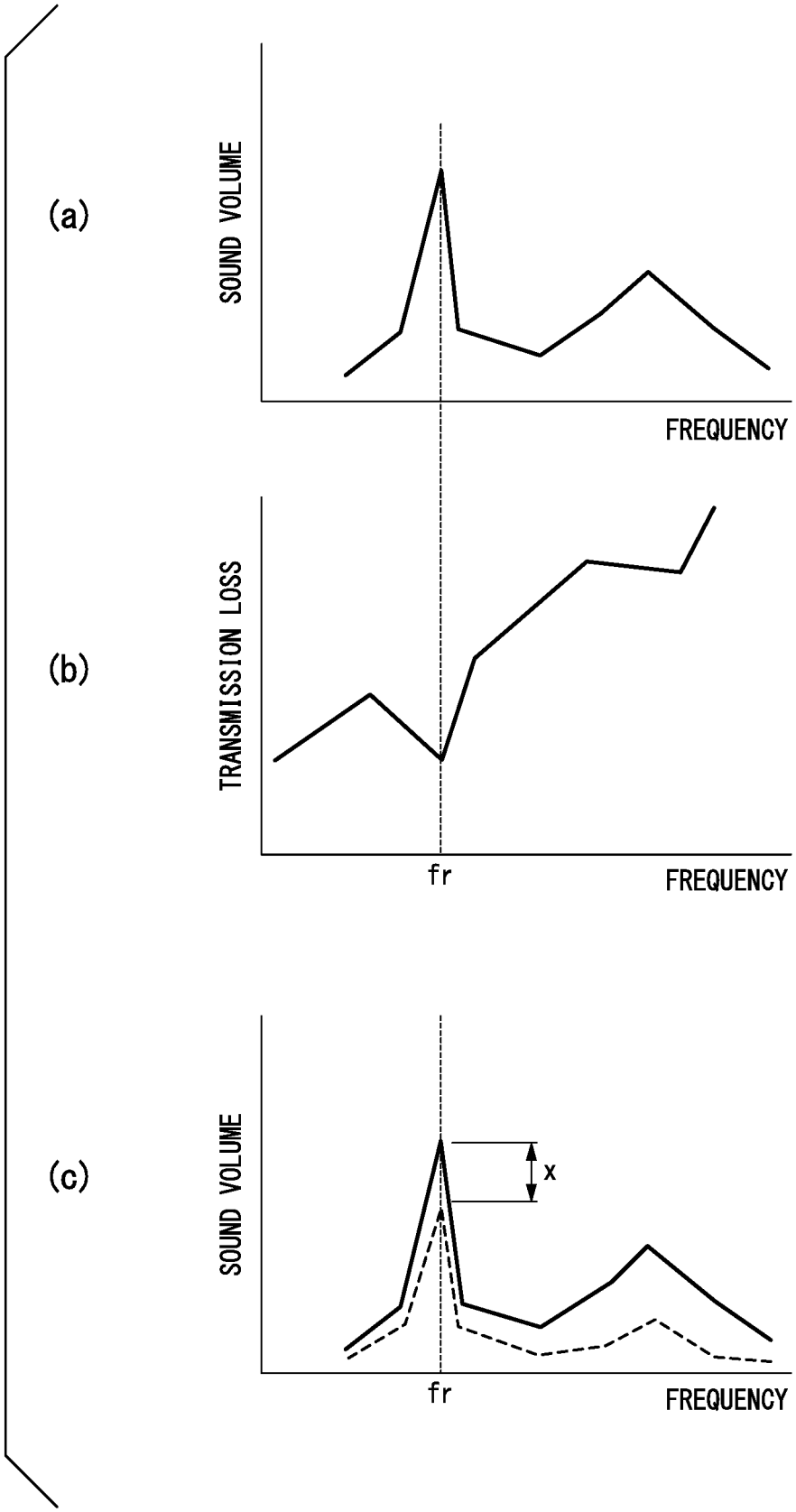
FIG. 3 is a first diagram for explaining soundproofing performance.

FIG. 3 is a first diagram for explaining soundproofing performance.

FIG. 3(*a*) shows a sound volume corresponding to a frequency of sound generated by a steam condenser serving as a sound generation source. FIG. 3(*b*) shows a transmission loss ratio corresponding to a sound frequency of the soundproofing wall 50. FIG. 3(*c*) shows a change in a sound volume corresponding to a frequency outside the soundproofing wall 50 between before covering (solid line) and after covering (dashed line) of the steam condenser 40 by the soundproofing wall 50. As shown in FIG. 3(*b*), in the soundproofing wall 50, a sound transmission loss is low at a specific resonance frequency fr. When a sound volume of the steam condenser 40 serving as a generation source is largest at the same frequency fr as a resonance frequency fr, since a transmission loss of the soundproofing wall 50 at the frequency fr is low, a sufficient sound reduction effect may not be obtained. Therefore, as shown in FIG. 3(*c*), an amount of reduction in sound volume at the frequency fr becomes x and a desired amount of reduction may not be obtained. Therefore, it is necessary to eliminate such a phenomenon and increase a reduction effect of a sound volume at the frequency fr. Therefore, the soundproofing control device 1 included in the soundproofing control system 200 has a configuration shown in FIG. 4 and FIG. 5.

Here, the resonance frequency fr is obtained by the following Formula (1). In Formula (1), $m_1$ denotes a surface density (kg/m$^2$) of the inner wall member 51, $m_2$ denotes a surface density (kg/m$^2$) of an outer wall member, c denotes a sound velocity (m/s) in air, d denotes a thickness (m) of the hollow portion 53, and ρ denotes a density (kg/m$^3$) of air. When the density ρ of the air changes, the resonance frequency fr changes.

$$f_r = \frac{1}{2\pi}\sqrt{\frac{m_1 + m_2}{m_1 m_2} \cdot \frac{\rho c^2}{d}} \tag{1}$$

Figure 4:
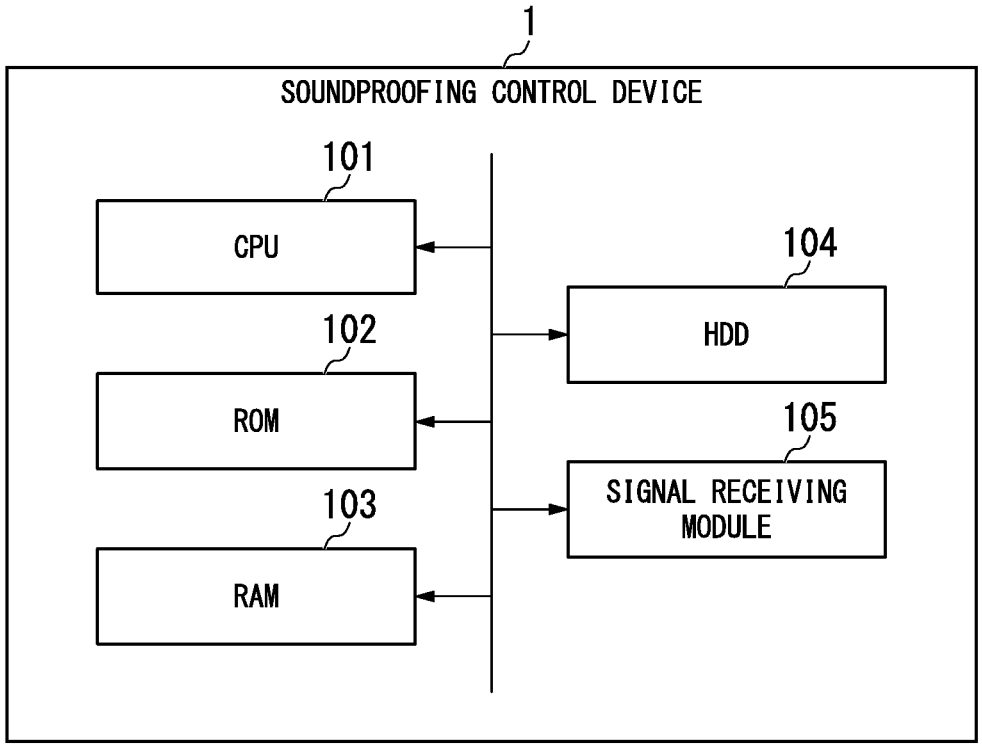
FIG. 4 is a diagram showing a hardware configuration of a soundproofing control device.

FIG. 4 is a diagram showing a hardware configuration of a soundproofing control device according to the present embodiment.

As shown in FIG. 4, the soundproofing control device 1 is a computer including a central processing unit (CPU) 101, a read only memory (ROM) 102, a random access memory (RAM) 103, a hard disk drive (HDD) 104, and a signal receiving module 105.

Figure 5:
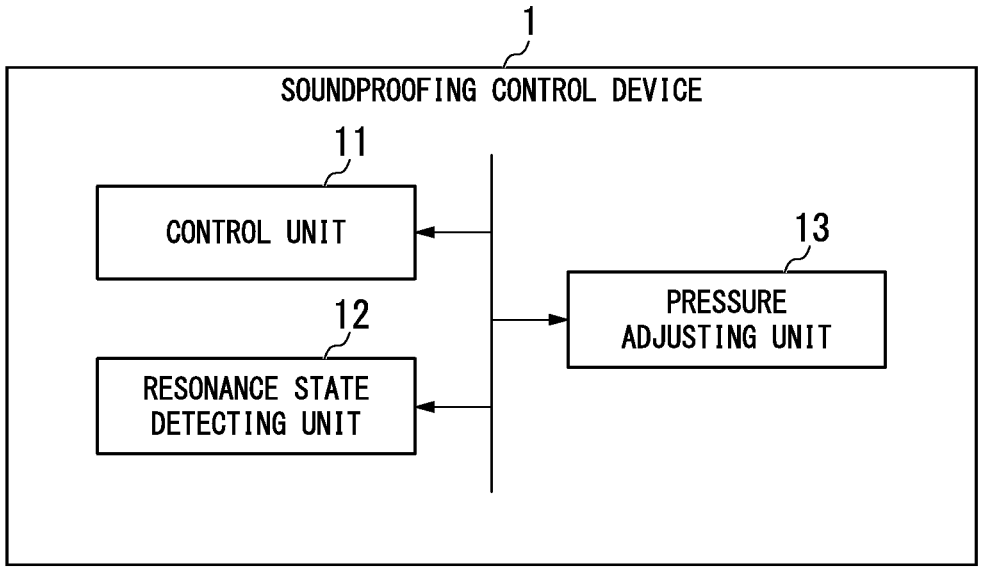
FIG. 5 is a functional block diagram of the soundproofing control device.

FIG. 5 is a functional block diagram of a soundproofing control device according to the present embodiment.

The CPU 101 of the soundproofing control device 1 executes a soundproofing control program which has been previously stored in the device itself, and has functions of a control unit 11, a resonance state detecting unit 12, and a pressure adjusting unit 13.

The control unit 11 controls functional units.

The resonance state detecting unit 12 detects a resonance state of the outer wall member 52 of the soundproofing wall 50.

The pressure adjusting unit 13 adjusts a pressure of the hollow portion 53 so that a resonance state is a minimum based on adjustment of a pressure of the hollow portion 53 of the soundproofing wall 50.

Figure 6:
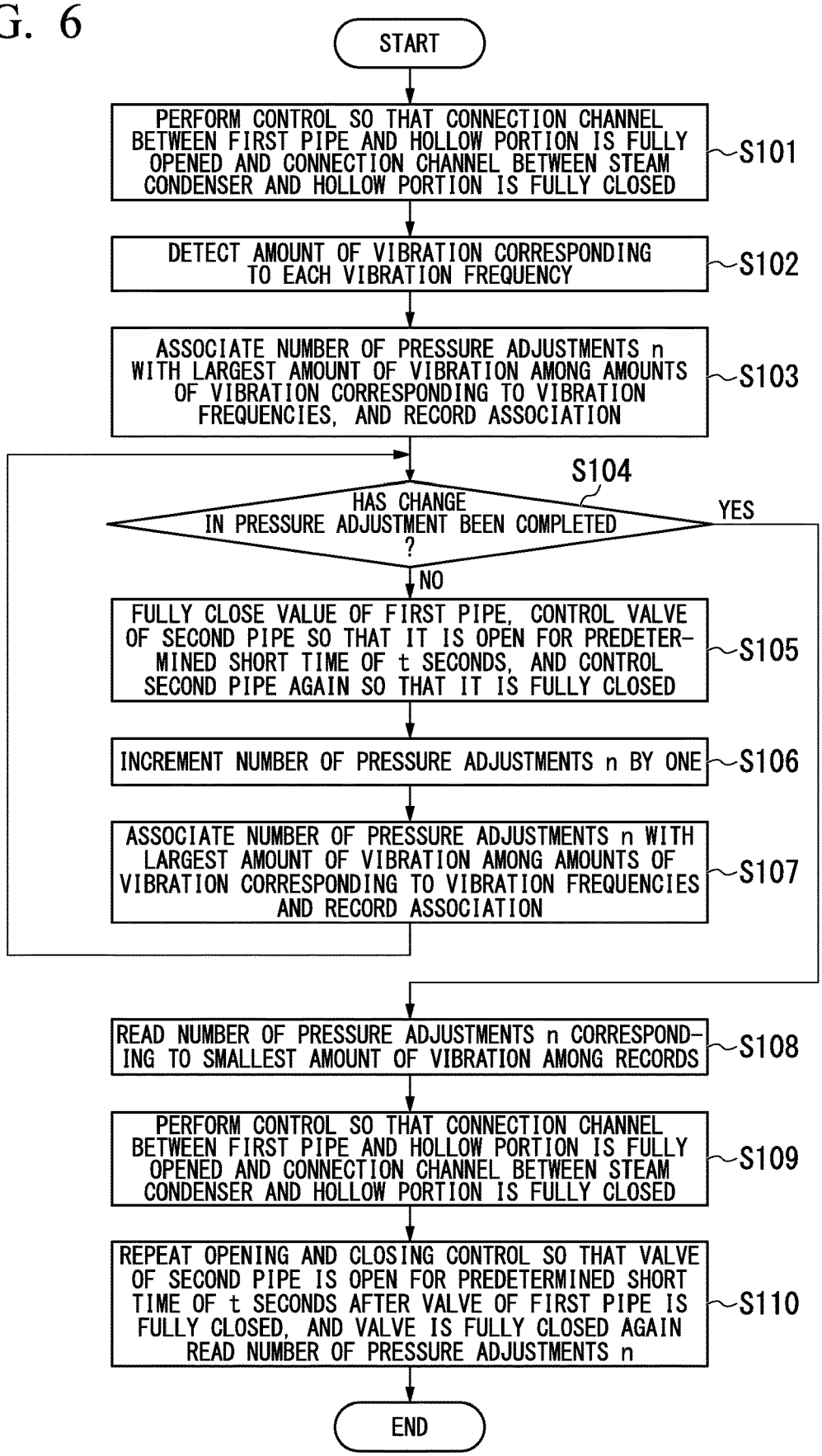
FIG. 6 is a diagram showing a processing flow of a soundproofing control device according to a first embodiment.

FIG. 6 is a diagram showing a processing flow of a soundproofing control device according to the first embodiment.

Next, the processing flow of the soundproofing control device will be described sequentially.

First, the control unit 11 of the soundproofing control device 1 instructs the pressure adjusting unit 13 to start control. Then, the pressure adjusting unit 13 controls the first pressure adjusting valve 2 so that a connection channel between the first pipe 61 and the hollow portion 53 of the soundproofing wall 50 is fully opened and a connection channel between the steam condenser 40 and the hollow portion 53 is fully closed (Step S101). During this time, the third pipe 63 is open. Therefore, a pressure inside the hollow portion 53 becomes atmospheric pressure The soundproofing control device 1 receives a detection signal from the vibration sensor 70. The resonance state detecting unit 12 detects an amount of vibration corresponding to respective vibration frequencies based on the detection signal (Step S102). Detection of an amount of vibration corresponding to respective vibration frequencies is one manner of a process of detecting a resonance state of the outer wall member 52. When an amount of vibration corresponding to vibration frequencies is detected, the resonance state detecting unit 12 associates a number of pressure adjustments n with the largest amount of vibration among amounts of vibration corresponding to these vibration frequencies, and records the association in a recording unit such as the HDD 104 (Step S103). The vibration frequencies may be, for example, frequencies with a predetermined frequency interval. Here, when the hollow portion 53 is at atmospheric pressure, the number of pressure adjustments n=0. The resonance state detecting unit 12 notifies the control unit 11 of recording of the amount of vibration. The control unit 11 determines whether change in pressure adjustment has been completed (Step S104).

When the number of pressure adjustments n has not reached a predetermined number of times, since a pressure inside the hollow portion 53 of the soundproofing wall 50 is not the same as the pressure inside the steam condenser 40, the control unit 11 instructs the pressure adjusting unit 13 to readjust a pressure. The pressure adjusting unit 13 fully closes the valve of the first pipe 61, controls the valve of the second pipe 62 so that it is open for a predetermined short time of t seconds, and controls the first pressure adjusting valve 2 again so that the second pipe 62 is fully closed (Step S105). Here, a degree of opening of the valve on the side of the second pipe 62 and an opening time of t seconds are a degree of opening at which a slight amount of air in the hollow portion 53 is released toward the steam condenser 40 with a lower pressure than that of atmospheric pressure and a time t. During this time, the control unit 11 controls the first pressure adjusting valve 2 so that the valve on the side of the third pipe 63 is open. Therefore, air enclosed in the hollow portion 53 is released toward the steam condenser 40 with a lower pressure than atmospheric pressure and a pressure of the hollow portion 53 decreases.

The pressure adjusting unit 13 notifies the control unit 11 of pressure adjustment completion. The control unit 11 causes the resonance state detecting unit 12 to detect an amount of vibration corresponding to a current vibration frequency based on a detection signal. The resonance state detecting unit 12 increments the number of pressure adjustments n by one (Step S106). The resonance state detecting unit 12 associates the number of pressure adjustments n with the largest amount of vibration among amounts of vibration corresponding to vibration frequencies and records the association (Step S107). The control unit 11 repeats the above processes of Step S104 to Step S107. Therefore, an amount of vibration when the pressure of the hollow portion 53 becomes atmospheric pressure to an amount of vibration when the pressure of the hollow portion 53 becomes the same pressure as the pressure inside the steam condenser 40 are sequentially recorded.

In Step S104, the control unit 11 determines whether the number of pressure adjustments n has reached a predetermined number of times and change in pressure adjustment has been completed. In this case, the pressure of the hollow portion 53 becomes the same pressure as the pressure inside the steam condenser 40. The control unit 11 instructs the pressure adjusting unit 13 to perform pressure adjustment so that the amount of vibration becomes the smallest. The pressure adjusting unit 13 reads records in the recording unit and reads the number of pressure adjustments n corresponding to the smallest amount of vibration among them (Step S108). Then, the pressure adjusting unit 13 controls the first pressure adjusting valve 2 again so that a connection channel between the first pipe 61 and the hollow portion 53 of the soundproofing wall 50 is fully opened and a connection channel between the steam condenser 40 and the hollow portion 53 is fully closed (Step S109). Therefore, the pressure of the hollow portion 53 is returned to a pressure the same as atmospheric pressure. Then, the pressure adjusting unit 13 repeats opening and closing control so that the valve of the second pipe 62 is open for a predetermined short time of t seconds after the valve of the first pipe 61 is fully closed, and the valve is fully closed again the number of pressure adjustments n read in Step S108 (Step S110). Therefore, the pressure of the hollow portion 53 is controlled such that it reaches a pressure corresponding to a state in which the amount of vibration is the smallest. In addition, a value when the amount of vibration corresponding to the frequency detected by the resonance state detecting unit 12 is the largest becomes the smallest.

According to the above control, an air density ρ inside the hollow portion 53 decreases. Therefore, the resonance frequency decreases based on the above Formula (1), and a transmission loss at the predetermined resonance frequency fr specific to the soundproofing wall 50 increases. Therefore, even in the soundproofing wall 50 in which the amount of vibration at the resonance frequency fr is the largest, soundproofing performance can be improved.

That is, according to the above control, the soundproofing control device 1 can improve soundproofing performance of the soundproofing wall 50 constituted by wall members overlapping with the hollow portion 53 therebetween by changing the resonance frequency at which a transmission loss decreases.

Figure 7:
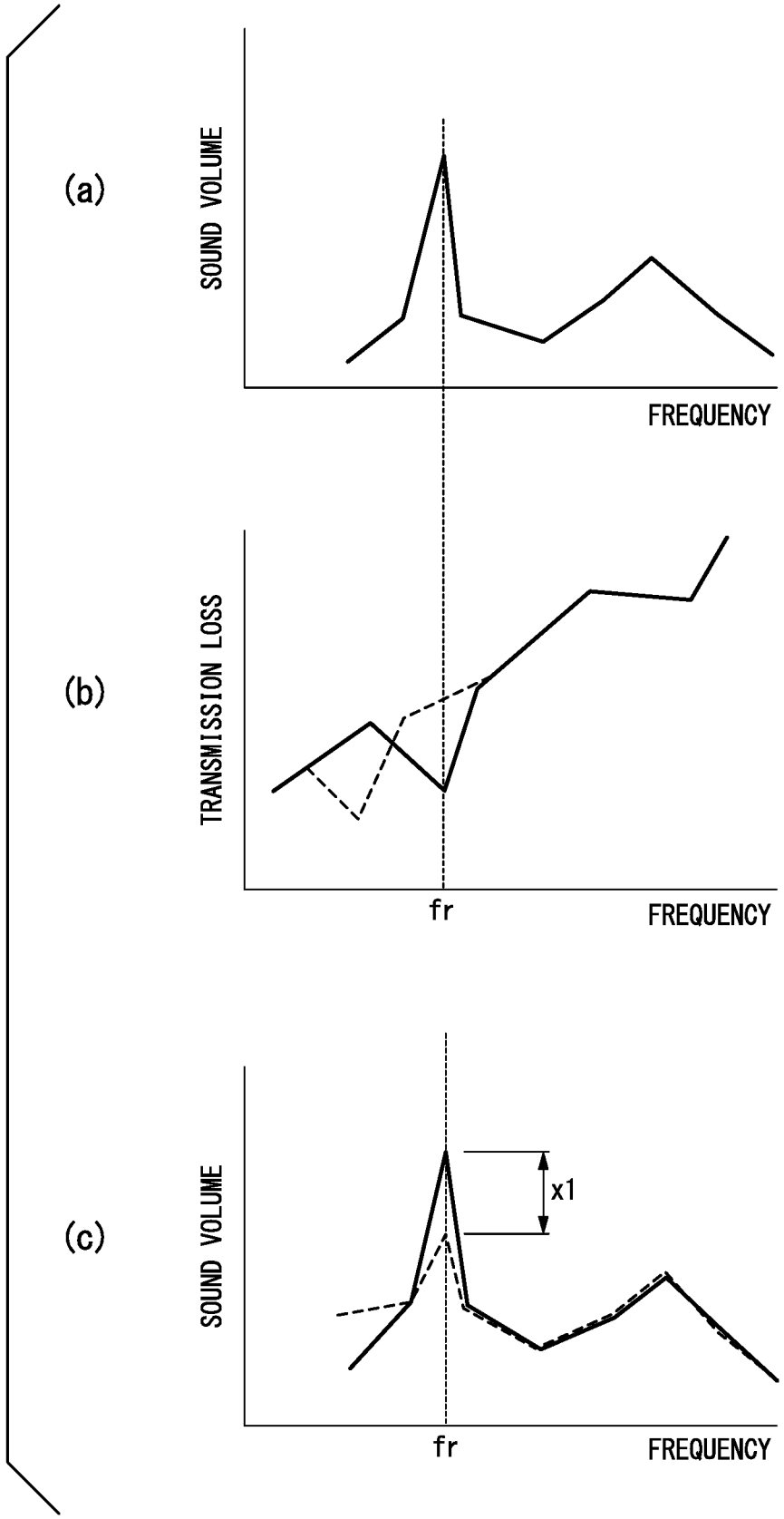
FIG. 7 is a second diagram for explaining soundproofing performance.

FIG. 7 is a second diagram for explaining soundproofing performance.

FIG. 7(*a*) shows a sound volume corresponding to a frequency of sound generated by a steam condenser serving as a sound generation source. FIG. 7(*b*) shows a transition of a transmission loss ratio corresponding to a sound frequency of the soundproofing wall 50 from before control (solid line) to after control (dashed line). FIG. 7(*c*) shows a change in a sound volume corresponding to a frequency outside the soundproofing wall 50 between before covering (solid line) and after covering (dashed line) the steam condenser 40 by the soundproofing wall 50 after control.

According to the above control of the soundproofing control device 1, as indicated by a dashed line in FIG. 7(*b*), a position of the frequency fr at which a transmission loss decreases moves toward a lower frequency. This is apparent from a calculation result of Formula (1) when the air density decreases. In this manner, as shown in FIG. 7(*b*), since a frequency at which a transmission loss is lower than that at the same frequency as the resonance frequency fr of the soundproofing wall 50 is changed, it is possible to improve soundproofing performance when a volume of sound generated at this frequency is the largest. As shown in FIG. 7(*c*), a sound volume outside the soundproofing wall 50 after control at the frequency fr can be reduced by x1 (<x).

Second Embodiment

Figure 8:
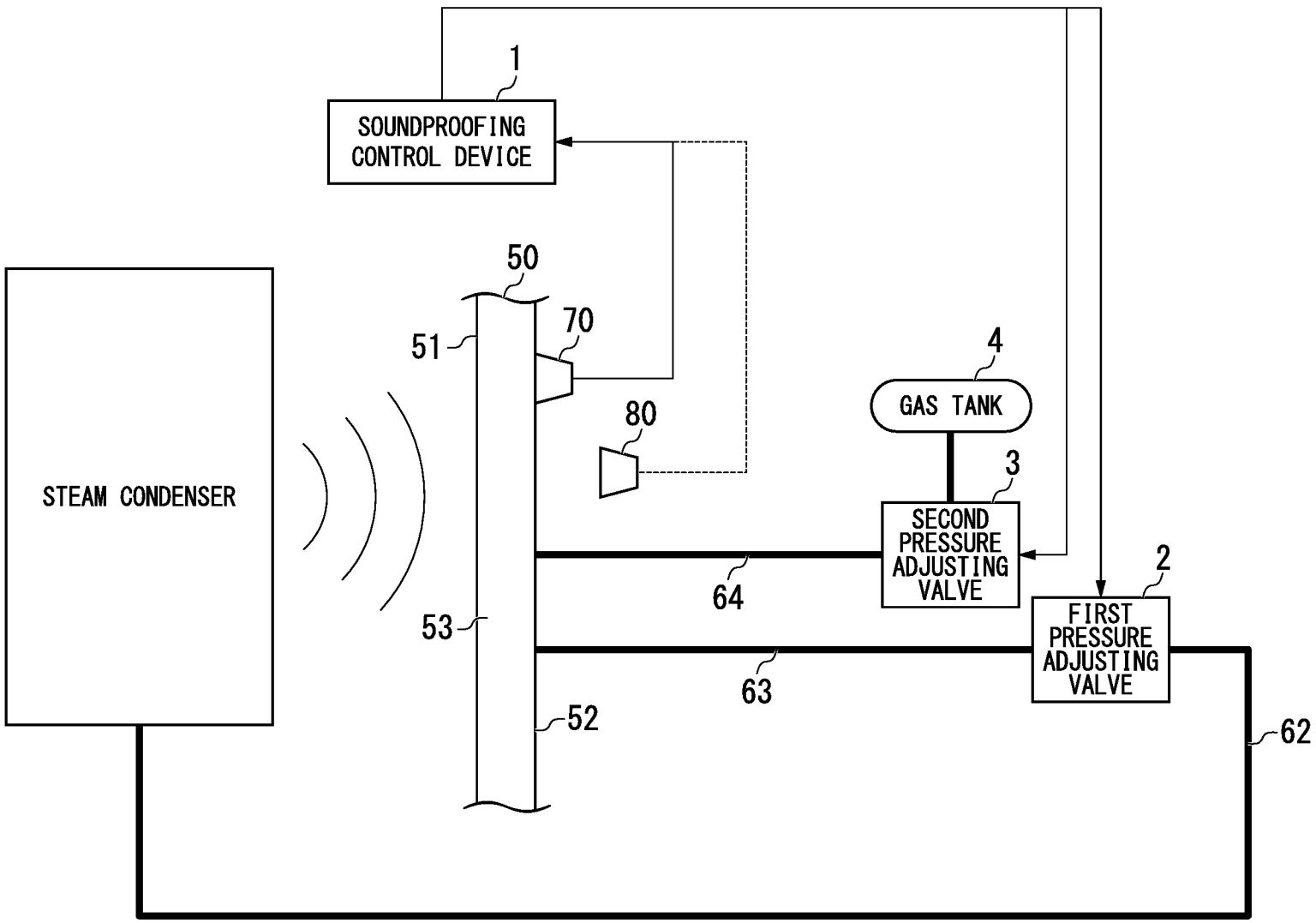
FIG. 8 is a schematic configuration diagram of a soundproofing control system according to a second embodiment.

FIG. 8 is a schematic configuration diagram of a soundproofing control system according to a second embodiment.

In the first embodiment, the pressure inside the hollow portion 53 can be controlled such that it is within a range from atmospheric pressure to a pressure of the steam condenser 40. On the other hand, in the second embodiment, when a gas is sent to the hollow portion 53, the pressure inside the hollow portion 53 is controlled such that it is within a range from a pressure larger than atmospheric pressure to the pressure of the steam condenser 40.

Therefore, the soundproofing control system 200 according to the second embodiment includes a second pressure adjusting valve 3, a gas tank 4 into which a gas is filled, and a fourth pipe 64 through which a gas sent from the gas tank is sent to the hollow portion 53 of the soundproofing wall 50 through the second pressure adjusting valve 3 in addition to the components of the soundproofing control system 200 according to the first embodiment. In addition, in the soundproofing control system 200 according to the second embodiment, the second pipe 62 for sending air to the hollow portion 53 is reduced in size.

Further, in the process of the soundproofing control device 1 according to the second embodiment, at a timing at which air and the hollow portion 53 in the first embodiment are connected, alternatively, the second pressure adjusting valve 3 is controlled so that the gas tank 4 and the hollow portion 53 are connected. The other processes are the same as those in the first embodiment. Therefore, the pressure of the hollow portion 53 is controlled such that it is within a range from a pressure larger than atmospheric pressure to the pressure of the steam condenser 40, an amount of vibration at each pressure is recorded, and the pressure is controlled such that it reaches a pressure at which the outer wall member 52 of the hollow portion 53 has the smallest amount of vibration.

Accordingly, irrespective of the resonance frequency of the soundproofing wall 50 constituted by wall members overlapping with the hollow portion therebetween corresponding to frequencies in a wider frequency band range, it is possible to improve soundproofing performance of the soundproofing wall 50.

Figure 9:
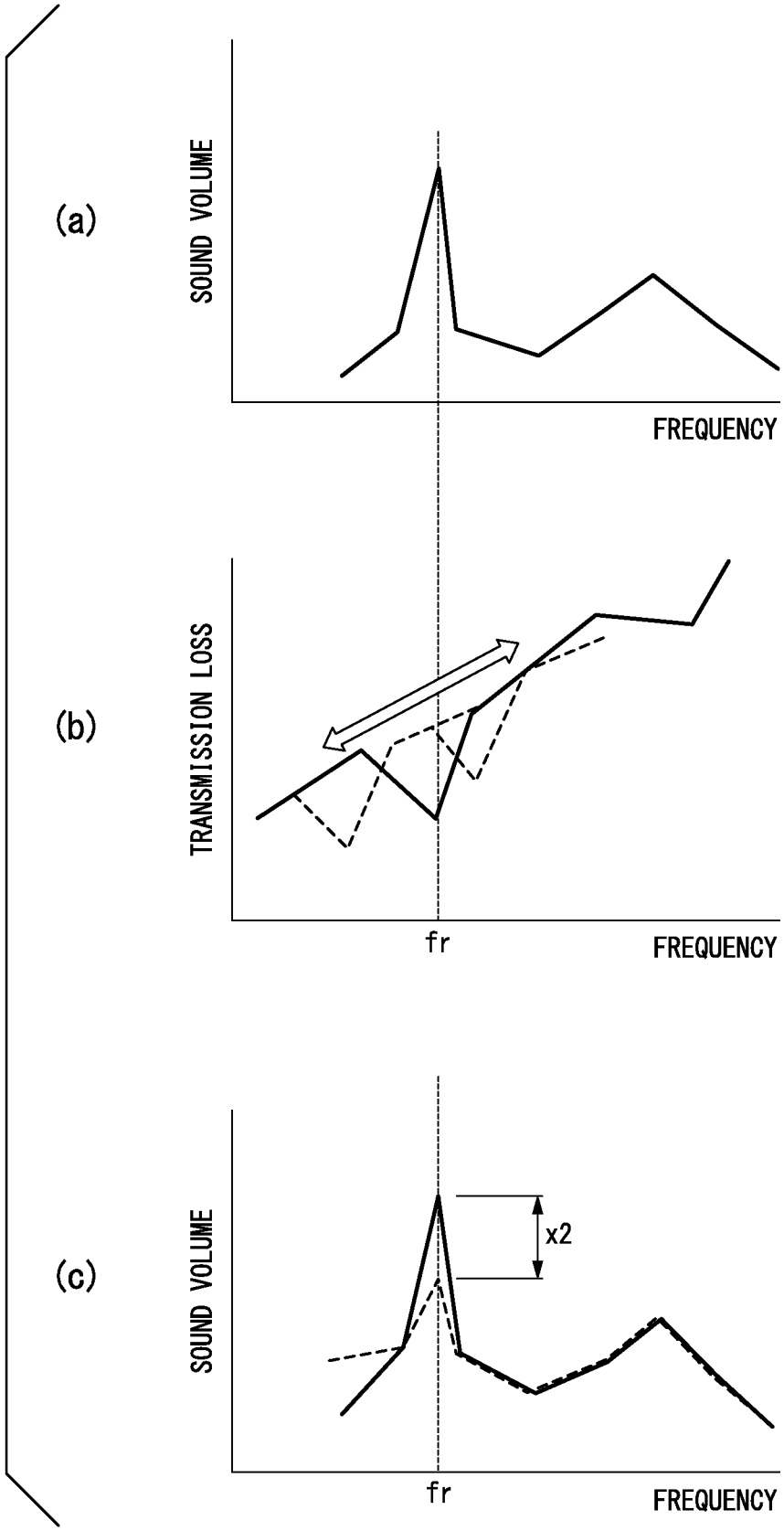
FIG. 9 is a third diagram for explaining soundproofing performance.

FIG. 9 is a third diagram for explaining soundproofing performance.

FIG. 9(*a*) shows a sound volume corresponding to a frequency of sound generated by a steam condenser serving as a sound generation source. FIG. 9(*b*) shows a transition of a transmission loss ratio corresponding to a sound frequency of the soundproofing wall 50 according to the second embodiment before control (solid line) and after control (dashed line). FIG. 9(*c*) shows a change in a sound volume corresponding to a frequency outside the soundproofing wall 50 between before covering (solid line) and after covering (dashed line) the steam condenser 40 by the soundproofing wall 50 after control.

According to control of the soundproofing control device 1 of the second embodiment, as indicated by a dashed line in FIG. 9(*b*), a position of the frequency fr at which a transmission loss decreases may be moved to a range at a higher frequency or at a lower frequency. This is apparent from a calculation result of Formula (1) when a gas density inside the hollow portion 53 is increased or decreased due to the gas. In this manner, as shown in FIG. 9(*b*), since a frequency at which a transmission loss is lower than that at the same frequency as the resonance frequency fr of the soundproofing wall 50 may be changed in a high frequency direction or a low frequency direction, it is possible to improve soundproofing performance when a volume of sound generated in this frequency range is the largest.

While the soundproofing control device 1 in the above embodiments controls the pressure inside the hollow portion 53 so that an amount of vibration corresponding to each frequency detected by the vibration sensor 70 is the smallest, it may control the pressure inside the hollow portion 53 so that a sound volume corresponding to each frequency detected by the sound sensor 80 is the smallest. The process of the soundproofing control device 1 in this case is the same as that of the above embodiments.

The above soundproofing control device includes a computer system therein. Thus, the above process procedures in a program format are stored in a computer readable recording medium and when the computer reads and executes the program, the process is performed. Here, the computer readable recording medium includes a magnetic disk, a magneto-optical disc, a CD-ROM, a DVD-ROM, a semiconductor memory, and the like. In addition, the computer program may be transmitted to a computer through a communication line, and the computer that has received such a transmission may execute the program.

In addition, the above program may also include a program for implementing a part of the above-described functionality and include a so-called a discrete file (differential program) in which the above-described functionality is implemented in combination with a program that has already been recorded in the computer system.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

EXPLANATION OF REFERENCES

1 Soundproofing control device
2 First pressure adjusting valve

3 Second pressure adjusting valve
4 Gas tank
11 Control unit
12 Resonance state detecting unit
13 Pressure adjusting unit
40 Steam condenser
50 Soundproofing wall
51 Inner wall member
52 Outer wall member
53 Hollow portion
61 First pipe
62 Second pipe
63 Third pipe
70 Vibration sensor
80 Sound sensor

What is claimed is:

1. A soundproofing control system comprising:

a soundproofing wall comprising:

an inner wall member disposed proximately to a sound generation source;

an outer wall member disposed farther from the sound generation source than the inner wall member is; and a hollow portion between the inner wall member and the outer wall member;

a resonance state detecting unit configured to detect an amount of vibration at a vibration frequency using a sensor disposed proximately to the outer wall member of the soundproofing wall, wherein the amount of vibration is associated with a resonance state of the outer wall member; and a pressure adjusting unit configured to perform pressure adjustment multiple times such that an inner pressure of the hollow portion of the soundproofing wall is decreased stepwise from a first pressure to a second pressure and the amount of vibration is decreased.

2. The soundproofing control system according to claim 1, wherein the sound generation source is a steam condenser for steam discharged from a turbine, the soundproofing wall covers the sound generation source, the pressure adjusting unit is configured to adjust the inner pressure of the hollow portion to an intermediate pressure between the first pressure and the second pressure, the first pressure is atmospheric pressure, and the second pressure is an internal pressure of the steam condenser that is lower than atmospheric pressure.

3. The soundproofing control system according to claim 1, further comprising:

a pressure adjusting valve comprising a channel to the hollow portion, wherein the channel is connected with either a first pipe configured to introduce the first pressure or a second pipe configured to introduce the second pressure, and the pressure adjusting unit is configured to carry out an open/close control of the pressure adjusting valve.

4. A soundproofing control device adapted to a soundproofing wall comprising: an inner wall member disposed proximately to a sound generation source; an outer wall member disposed farther from the sound generation source than the inner wall member is; and a hollow portion formed between the inner wall member and the outer wall member, comprising:

a resonance state detecting unit configured to detect an amount of vibration at a vibration frequency using a sensor disposed proximately to the outer wall member of the soundproofing wall, wherein the amount of vibration is associated with a resonance state of the outer wall member; and a pressure adjusting unit configured to perform pressure adjustment multiple times such that an inner pressure of the hollow portion of the soundproofing wall is decreased stepwise from a first pressure to a second pressure and the amount of vibration is decreased.

5. The soundproofing control device according to claim 4, wherein the pressure adjusting unit is configured to carry out an open/close control of a pressure adjusting valve comprising a channel to the hollow portion, and the channel is connected with either a first pipe configured to introduce the first pressure or a second pipe configured to introduce the second pressure.

6. A soundproofing control method comprising:

covering a sound generation source with a soundproofing wall comprising:

an inner wall member disposed proximately to the sound generation source; an outer wall member disposed farther from the sound generation source than the inner wall member is; and a hollow portion between the inner wall member and the outer wall member;

detecting an amount of vibration at a vibration frequency using a sensor disposed proximately to the outer wall member of the soundproofing wall, wherein the amount is associated with a resonance state of the outer wall member; and performing pressure adjustment multiple times such that an inner pressure of the hollow portion of the soundproofing wall is decreased stepwise from a first pressure to a second pressure and the amount of vibration is decreased.

7. The soundproofing control method according to claim 6, wherein the pressure adjustment is performed by carrying out an open/close control of a pressure adjusting valve comprising a channel to the hollow portion, and the channel is connected with either a first pipe configured to introduce the first pressure or a second pipe configured to introduce the second pressure.

8. A non-transitory computer-readable storage medium having a program causing a computer in a soundproofing control device to carry out a soundproofing control process for a soundproofing wall comprising: an inner wall member disposed proximately to a sound generation source; an outer wall member disposed farther from the sound generation source than the inner wall member is; and a hollow portion between the inner wall member and the outer wall member, the soundproofing control process comprising:

detecting an amount of vibration corresponding to a vibration frequency using a sensor disposed proximately to the outer wall member of the soundproofing wall, wherein the amount of vibration is associated with a resonance state of the outer wall member; and performing pressure adjustment multiple times such that an inner pressure of the hollow portion of the soundproofing wall is decreased stepwise from a first pressure to a second pressure and the amount of vibration is decreased.

* * * * *